United States Patent [19]

Echols

[11] 4,315,475

[45] Feb. 16, 1982

[54] KNOCKDOWN CATAMARAN

[76] Inventor: John B. Echols, 725 N. Pearl St., Natchez, Miss. 39120

[21] Appl. No.: 128,198

[22] Filed: Mar. 7, 1980

[51] Int. Cl.[3] ..... B63B 7/00

[52] U.S. Cl. ..... 114/61; 9/2 C

[58] Field of Search ..... 9/2 R, 2 C, 2.5; 114/61

[56] References Cited

U.S. PATENT DOCUMENTS

| | | | |
|---|---|---|---|
| 1,151,115 | 8/1915 | Maxwell | 9/2 R |
| 2,332,259 | 10/1943 | Reuther | 9/2 C |
| 2,529,745 | 11/1950 | Stanley | 9/2 C |
| 3,273,528 | 9/1966 | Kiefer | 114/61 |
| 3,968,532 | 7/1976 | Bailey | 114/61 |

*Primary Examiner*—Trygve M. Blix
*Assistant Examiner*—John C. Paul
*Attorney, Agent, or Firm*—Fleit & Jacobson

[57] ABSTRACT

A watercraft for use by an individual, for fishing, general recreational or other purposes is disclosed. The craft is formed from a pair of elongate pontoon-type floats and a detachable frame interconnecting the floats in laterally spaced relationship. The frame includes an elevated swivel seat positioned so that an occupant can rest his feet on one of the frame cross bars. This cross bar conveniently forms a mounting for a trolling motor so that the motor controls come readily to the occupant's hands. A particular form of attachment means is also disclosed for releasably connecting the frame to the floats.

6 Claims, 4 Drawing Figures

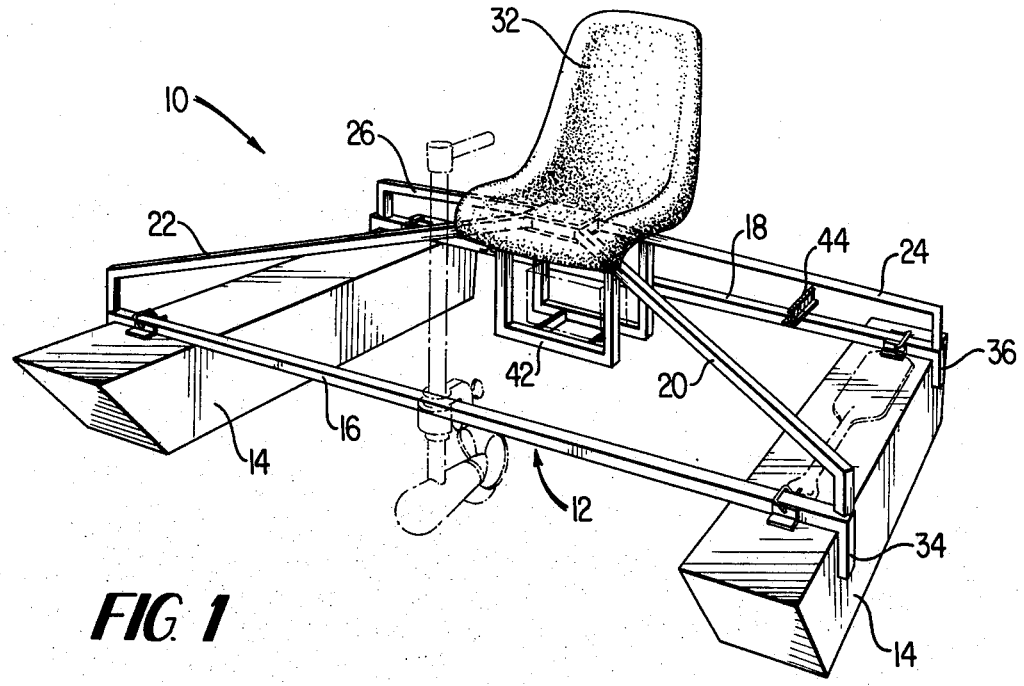
FIG. 1
FIG. 2
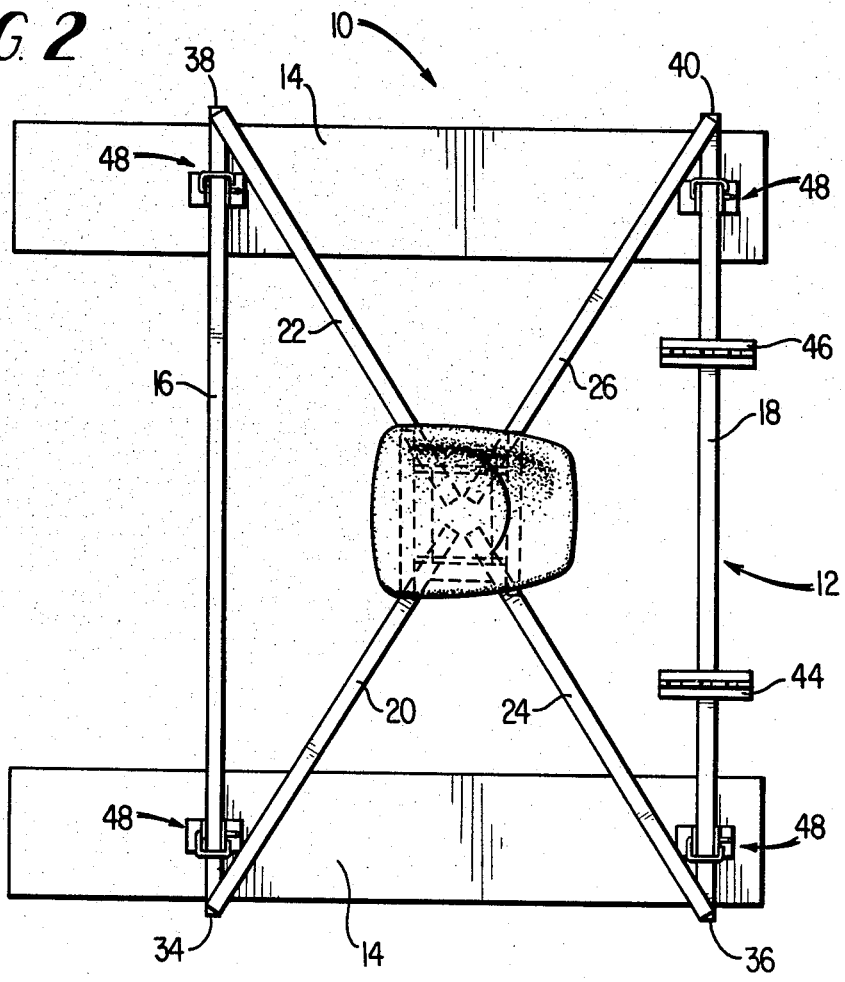

KNOCKDOWN CATAMARAN

BACKGROUND OF THE INVENTION

This invention rlates to a portable watercraft suitable for use by an individual for fishing, general recreational or other purposes.

It is an object of the invention to provide a watercraft construction comprising a pair of pontoon-like floats and a frame structure for interconnecting the floats and accommodating a user and which construction can be readily assembled and disassembled by an individual.

Another object of the invention is to provide a pontoon type boat which is light in weight, relatively simple to put together, take apart and transport and which provides a stable carft when assembled.

A further object of the invention is to provide a novel multi-purpose lightweight boat for use by an individual and which can be powered either manually or by a motor.

Still another object of the present invention is to provide a watercraft comprising a pair of pontoon-like floats, a frame structure for interconnecting the floats and providing seating accommodation for at least one occupant and wherein novel attachment means is provided between the frame structure and the floats for releasably attaching these components together in a secure and stable manner.

A still further object of the invention is to provide a lightweight knock-down boat construction comprising a pair of pontoon-like floats and a detachable frame structure interconnecting the floats, the frame structure including a swivel seat.

SUMMARY OF THE INVENTION

In accordance with the invention, there is provided a portable boat construction comprising a pair of pontoon-like floats, fabricated from lightweight metal sheet or the like and a frame structure releasably attached to the floats and which provides both a bracing structure and also a mounting means for a seat and various accessories.

The frame structure is fabricated from metal struts, tubing or the like and comprises cross members and diagonally extending risers which terminate in a central mounting for a swivel seat. The cross members and risers are co-terminus at their outer ends, at which locations the frame work is provided with downwardly extending legs, which fit against the outer surfaces of the respective floats to laterally locate the floats and provide braces which prevent outward rotation of the floats. On their upper surfaces, the floats are provided with lateral locating channels for the respective cross members and locking pins are provided for fastening the cross members in the channels.

A swivel seat is mounted atop the risers and the height of the risers and distance between the cross members is such that when seated, a user can conveniently rest his or her feet on one of the cross members. Also, either one of the cross members provides a convenient mounting for an outboard type trolling motor which can conveniently be located between the operator's feet so that the operating handle comes readily to hand. Conveniently, the frame structure can include a battery box slung directly under the swivel seat mounting and the top surfaces of the floats and cross members can be used as storage spaces for fishing tackle, paddles or like accessories.

DESCRIPTION OF DRAWINGS

FIG. 1 is a front perspective view of a single-seater watercraft in an assembled condition;

FIG. 2 is a plan view of the watercraft;

DESCRIPTION OF PREFERRED EMBODIMENT

The drawings illustrate a single-seater watercraft 10, suitable for fishing, general recreational and other purposes and including a frame 12 and a pair of elongate pontoon-type floats 14, each of which is fabricated, in known manner, from light weight metal sheet or the like. Conveniently, the floats may be about 6 feet in length at the top and 5 feet at the bottom with a sloping front surface as shown.

Figure 3:
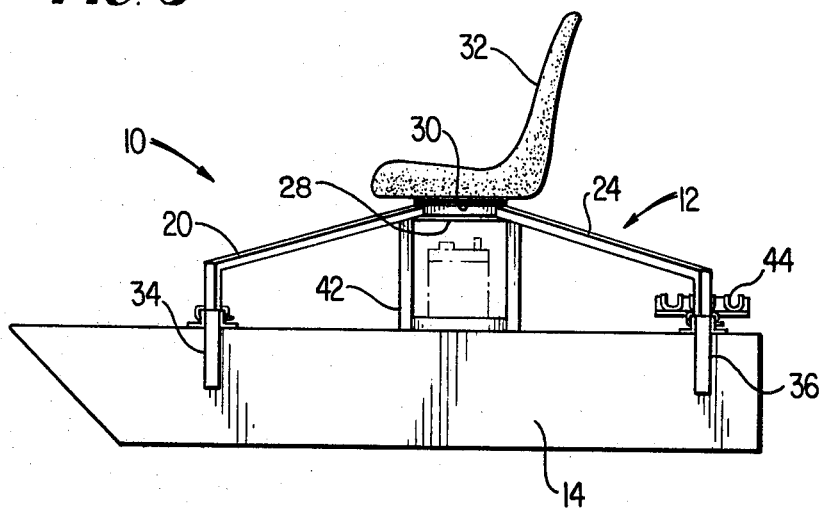
FIG. 3 is a side elevation of the craft.
Figure 4:
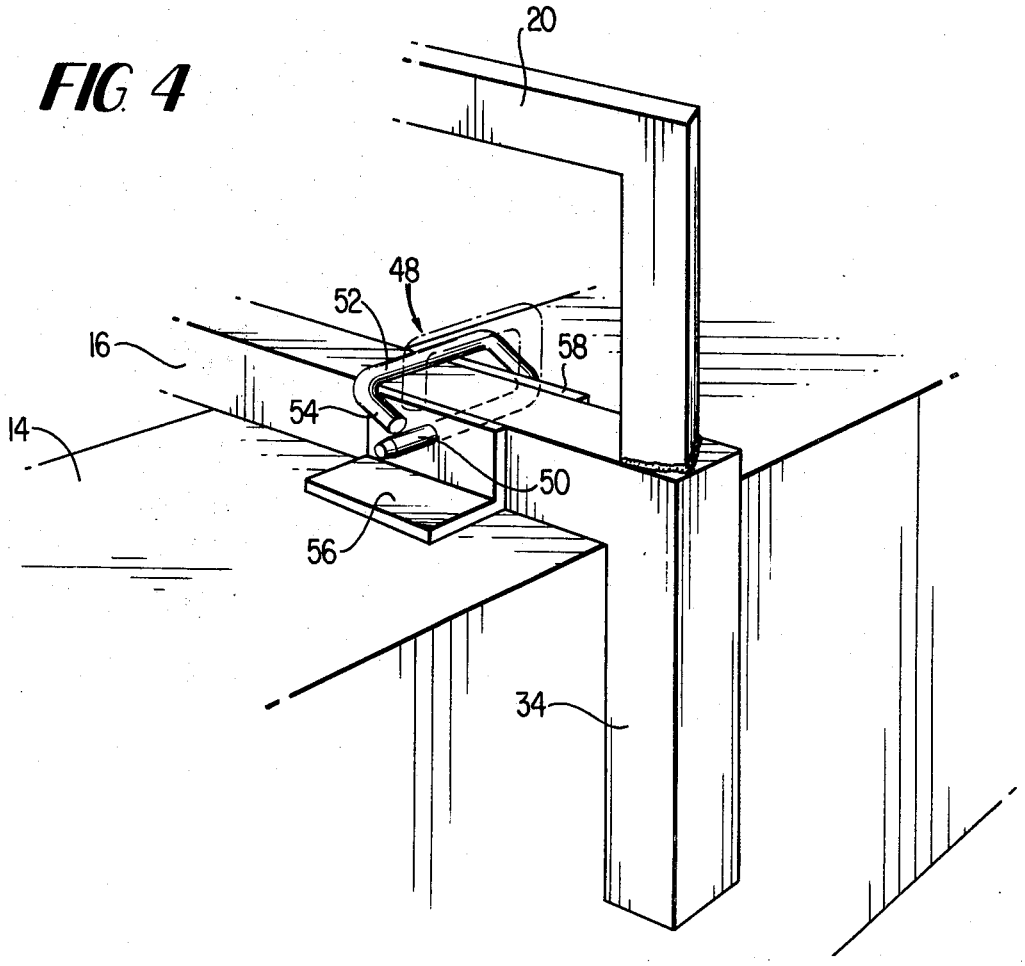
FIG. 4 is an enlarged perspective view of a part of the craft showing details of an attachment assembly between the craft frame and one of the floats.

Frame 12 is fabricated from lightweight metal tubing or the like and comprises front and rear cross members 16, 18 and diagonal risers 20, 22, 24 and 26 welded to and extending upwardly and inwardly from the ends of the respective cross members. The inner ends of the risers are sandwiched between and welded to plates 28 and 30, (see FIG. 3) which form a mounting bracket structure for a swivel seat 32, rotatably mounted by suitable rotary bearing means on the bracket structure. The risers and bracket structure thus interconnect and brace the cross members in spaced fore and aft relationship. As shown in FIGS. 1, 3 and 4, the opposite extremities of the cross members are bent over to form downwardly extending legs 34, 36, 38 and 40 which fit against the outer surfaces of the floats and effectively prevent the floats from rotating outwardly when the craft is assembled.

Frame 12 is further provided with a box structure 42 beneath seat 32, which may for example be used to accommodate a battery for a trolling motor (the battery and motor being shown in phantom line) and one of the cross members may have attached brackets 44, 46 which can be used for carrying fishing tackle and like accessories. The other cross member forms a convenient mounting for the trolling motor, as shown in FIG. 1, and the height of the seat and its spacing from this cross member is such that an occupant can rest his or her feet on the cross member on opposite sides of the motor, whereby the motor control handle comes readily to hand. The craft can alternatively be operated by a paddle, which can be stowed on the top of one of the floats as shown.

A preferred means for attaching the frame cross members to the floats is illustrated in detail in FIG. 4. Each attachment means includes a pair of angle-section members 56, 58 welded to the top surface of the respective float and defining a channel therebetween in which the cross member is received, the channel members thereby locating the cross members fore and aft relative to the floats. Aligned openings are formed in the angle members and in the cross member to receive a brass locking pin 48 generally in the shape of a P. Pin 48 has a straight shank portion 50 and a U-shaped head portion 52 having a bent over end section 54. Clearance is provided between end section 54 and shank portion 50 to allow the shank portion to be inserted in the aligned openings while head portion 52 is held in an upright position (shown in phantom line in FIG. 4), the clearance being just sufficient for end section 54 to clear the top of the angle members and cross member in this upright position of the head portion. When the shank portion has been inserted through the aligned openings, the pin is swivelled to the position shown in full line, wherein end section 54 no longer can clear the top of the angle members and cross member, so that the pin is effectively locked in position and cannot be removed to release frame 12 from the respective float until the pin is again swivelled into the upright position. End section 54 of pin 48 thus forms a locking section, in the position of the pin shown in full line, which engages one of the angle members to prevent withdrawal of the pin.

It is possible, within the scope of the invention, for each attachment means to have only a single angle member, with the length of the head portion of pin 48 being such that the frame cross member is stabilized between the opposite ends of the pin, when it is swivelled to the full line position.

When assembled, the floats and frame provide a braced and stable structure which can be readily taken apart simply by withdrawal of the four locking pins. It is evident that the invention provides a watercraft construction which is relatively simple to assemble and take apart by an individual, which can be readily transported and stored, and which is well suited for use in fishing, general recreational or other purposes.

While only a single preferred embodiment of the invention has been described in detail, it will be understood that the invention is not limited to the specific features of this embodiment and modifications can be made within the scope of the attached claims.

What is claimed is:

1. A knock-down watercraft assembly comprising:

a pair of elongate floats, each having a top area and a side area;

frame structure means for interconnecting said floats in laterally spaced relation substantially parallel to each other, said frame structure means including, a pair of cross member struts, each having downwardly extending legs at opposite ends thereof, attachment means for releasably connecting each cross member strut, in substantially parallel relationship to each other, to said elongate floats such that the pair of elongate floats and pair of cross member struts are in rectangular relationship and the area enclosed within the pair of cross member struts and pair of elongate floats is open, said attachment means comprising laterally extending channels mounted on the top area of the elongate floats, said channels receiving the cross member struts such that each cross member strut lies against the top area of the elongate float and each downwardly extending leg lies against the side area of the elongate float to prevent rotation of the elongate float with respect to the cross member strut, and connecting means for releasably connecting the channels with the cross member struts, a plurality of diagonal risers, each diagonal riser comprising a strut having an upwardly extending end portion affixed to the cross member strut substantially adjacent to the laterally extending channel, and having a major portion extending from the end portion in a direction toward the center of the rectangle defined by the elongate floats and cross member struts and angled upward with respect to the cross member struts;

swivel seat mounting means interconnecting each diagonal riser substantially at the center of the rectangle defined by the elongate floats and cross member struts; and a swivel seat rotatably mounted on said swivel seat mounting means, wherein the distance between the cross member struts and the height of the swivel seat above the cross member struts are such that one of said cross member struts provides a foot rest for an operator seated in said seat.

2. The craft as defined in claim 1, wherein said channels and said cross member struts have aligned openings substantially parallel to the elongate floats and said connecting means comprises a pin insertable into each opening, each said pin including a head portion extending over the respective channel and cross member strut and terminating in a locking section, said locking section clearing the respective channel and cross member strut on insertion of the pin and locking against said channel and cross member strut when the pin is rotated about its axis to prevent withdrawal of the pin.

3. The craft as defined in claim 2 wherein said head portion of each of said pins is substantially U-shaped, the base of the U extending in parallel to the axis of the pin, the head portion being connected to one end of the pin through one arm of the U, with clearance being provided between the body of the pin and other arm of the U.

4. The craft as defined in claim 3 wherein the pin has a greater length than the base of the U.

5. The craft as defined in claim 1, further comprising a box structure means for holding a battery mounted underneath said swivel seat mounting means.

6. The craft as defined in claim 1, wherein one of said cross member struts includes a trolling motor mounted thereon.

* * * * *